United States Patent [19]

van den Haak

[11] Patent Number: 4,526,123

[45] Date of Patent: Jul. 2, 1985

[54] ANCHOR RACK

[76] Inventor: Rob van den Haak, Allegro 114, Krimpen A/D Ijssel, Netherlands

[21] Appl. No.: 289,440

[22] Filed: Aug. 3, 1981

[30] Foreign Application Priority Data

Aug. 6, 1980 [NL] Netherlands ..... 80 04476

[51] Int. Cl.[3] ..... B63B 21/22

[52] U.S. Cl. ..... 114/210

[58] Field of Search ..... 114/210, 268, 269, 368, 114/369, 365; 212/190

[56] References Cited

U.S. PATENT DOCUMENTS

| | | | |
|---|---|---|---|
| 1,640,671 | 8/1927 | Schauman | 114/210 |
| 2,853,039 | 12/1955 | Fuerst | 114/210 |
| 2,931,331 | 4/1960 | Uebelhoer | 114/210 |
| 2,975,748 | 3/1961 | Uebelhoer | 114/210 |
| 3,071,097 | 1/1963 | Dowrelio | 114/210 |
| 3,186,373 | 6/1965 | Whitney | 114/210 |
| 3,261,319 | 7/1966 | Ellis | 114/210 |
| 3,750,610 | 8/1973 | Davis | 114/210 |
| 3,974,793 | 8/1976 | Aring | 114/210 |

FOREIGN PATENT DOCUMENTS

| | | | |
|---|---|---|---|
| 676490 | 7/1979 | U.S.S.R. | 114/210 |

*Primary Examiner*—Trygve M. Blix
*Assistant Examiner*—Thomas J. Brahan
*Attorney, Agent, or Firm*—Ladas & Parry

[57] ABSTRACT

An anchor rack with a davit post pivoted on deck to pivot in a vertical plane and supporting a jib provided with a fang to catch and carry an anchor at its shackle pin which is intercepted when hauling the anchor line to the davit and then pivoting the davit post with jib from an outboard extended position with the anchor payed out to a retracted position inboard with the anchor racked, and with a pulley on top of the davit post to pass the anchor line to the winch.

4 Claims, 5 Drawing Figures

ANCHOR RACK

BACKGROUND OF THE INVENTION

This invention relates to an anchor rack.

At the present time such a rack is arranged outboard alongside the ship but it is then prone to inflict damage to other vessels, and so exposed may be damaged itself.

The aim is therefore to place the rack inboard as an anchor davit in which case the problems to be solved are that not only should the anchor line which, in view of the fact that ships are to be anchored always further from the shore in deep water, now mostly is a steel rope, pass free from the board edge as such a steel rope would even cut through the tubulure of a hawsepipe and would then be damaged itself as well, but also should the anchor properly pass the board edge.

SUMMARY OF THE INVENTION

The present invention offers a solution for both problems by providing an anchor rack, pivotally arranged inside of the board edge of a ship to move an anchor shackled to an anchor line running on a sheave on the anchor rack between positions racked on board and payed out, characterized in that said pivotal rack has a shackle pin fang carrying the anchor in its racked position and to and from its outboard position. This new anchor rack, the preferred embodiment of which is characterized in that said anchor rack has a davit post pivoted on its post base to pivot in a vertical plane and supporting a jib which has in its upper side a fang slot for the shackle pin, and further by a sheave on the post head to guide the anchor line between the shackle pin fang and the winch, does not only pass the anchor line free from the board edge but also heaves the anchor, freely suspended, without chafing.

The rack is automatically pivoted when heaving the anchor as, with the shackle pin caught, the shackle between shackle pin and anchor line is stopped against the sheave block on the post head so that when further hauling the anchor line by the winch the anchor rack, carrying the anchor, is pivoted up.

The rack is further adapted to take the anchor pull in all directions as the sheave block on the post head is adapted to pivot about an axis substantially parallel to the post, and the rack when pivoted down has a rest position right on the deck to take the anchor pull, said anchor pull which can amount to more than 25 times the anchor weight, then not being applied on the rack itself but being transmitted directly to the deck structure below it, and the jib of the rack has lateral arms nesting in a recess in the board edge to transmit their load, also when the anchor pull is laterally directed, to the deck structure. The rack has to carry only the anchor weight and can be quite a lightweight construction.

The herein disclosed anchor rack can also be used in combination with a hawse in the board wall, in which the anchor, carried by the rack, is to be heaved and stowed. The anchor carried by the rack will then be confined with its crown and fluke hands against the hawse wall, and the hawse has centrally a laterally open passage for the anchor shank. The shank, caught by the fang, can be carried by the upswinging rack through the central lateral passage of the hawse with its shackle to above deck until the anchor crown and flukes are arrested in the hawse.

The invention is described in more detail in the following specification with reference to the drawing, in which the invention is illustrated.

BRIEF DESCRIPTION OF THE DRAWING

FIG. 2 is a side view of the rack onto the rack head according to the arrow II in FIG. 1*b* in position a.

DESCRIPTION OF THE PREFERRED EMBODIMENT

Figure 1:
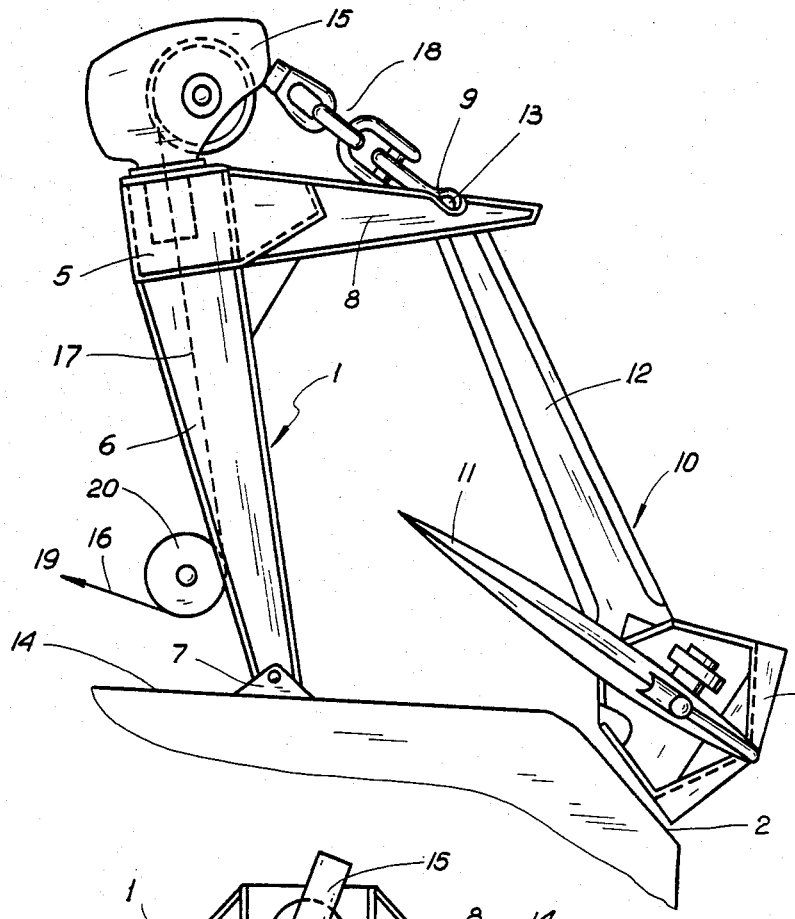
FIG. 1 shows a racked position of the anchor rack according to the present invention carrying the anchor.

In the drawing is represented an anchor rack 1 pivotally arranged along the board edge 2 of a ship 3 which is anchored in open water 4.

The rack 1 as represented comprising a davit 5 is composed of a post 6 having a pivot base 7, and rigidly connected thereto an outboard directed jib 8 having adjacent its outer end at the upper side a shackle pin engaging slot 9. When heaving it, the anchor 10, with its fluke(s) 11 and shank 12, is caught by the slot 9 at its shackle pin 13 and then carried further to its racked position in shown by position C of FIG. 1 FIG. 1. Position b is an intermediate position where the anchor 10 is intercepted by the slot 9. In position a the anchor rack 1 rests in a well supported manner right on the deck 14 of the ship 3 so that the anchor pull applied on the rack 1 in this position a is transmitted directly to the deck structure with the rack 1 thus being relieved.

Figure 2:
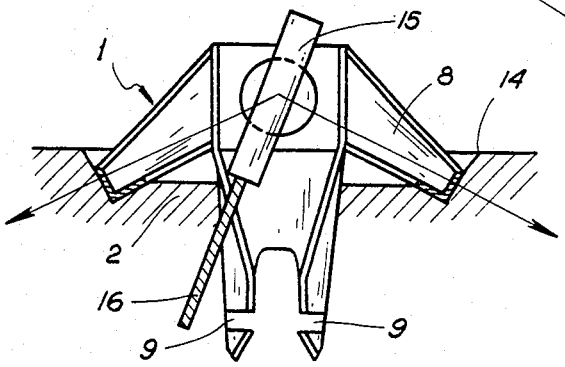

The jib 8 of the rack 1 as seen in FIG. 2 has lateral arms which when the rack 1 rests on the deck 14 are supported in a recess in the board edge 2 and can thus transmit their load under the anchor pull, particularly also when it is laterally directed, to the deck structure 14 below it as schematically indicated with arrows.

A sheave block 15 is positioned the anchor line 16. The post head and the sheave block are pivoted about an axis 17 which is substantially parallel to the longitudinal axis of the post 6, so as to be able to turn itself in the direction of the anchor pull in the anchor line 16 as illustrated in FIG. 2.

At the present time vessels such as supply vessels are to be anchored in open water 4 on an always deeper sea bed, the anchor line 16 instead of a chain mostly being a steel rope. A steel rope, however, cuts through the turbulure of the hawse and is then itself also damaged. This problem is solved by the use of the herein described rack 1. The line 16 always entirely free from the board edge 2. The anchor 10 itself depends freely in the slot 9 when it is moved beyond the board edge 2.

It is shown in FIG. 1 that the sheave 15 is positioned on the post head to guide the anchor line. Another sheave 20 is positioned near the pivot base 7 of the post. The anchor line 16 guided by these sheaves 15 and 20 passes centrally through the interior of the post.

When the anchor line 16 is hauled with its shackle 18 to the block 15, the rack 1 is then automatically pivoted by the applied winch force 19 from its rest position a, lying on the deck 14, via intermediate positions such as b up to its stowage position c in which the shackle 18 exactly spans the distance between the slot 9 and its arresting point on the block 15. The shackle pin 13 is always accurately intercepted by the slot 9 when pivoting the rack 1 and the anchor 10 is also properly arrested carried by the slot 9 in the stowage position c.

As it is indicated in FIG. 1 a sheave 20 is positioned about half way up on the post 6, to pass the anchor line 16 to the winch (not shown).

Figure 3:
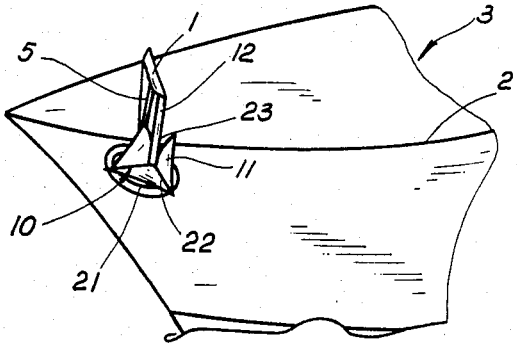
FIG. 3 shows the herein described anchor rack operating in combination with a board hawse.
Figures 1A, 1B:
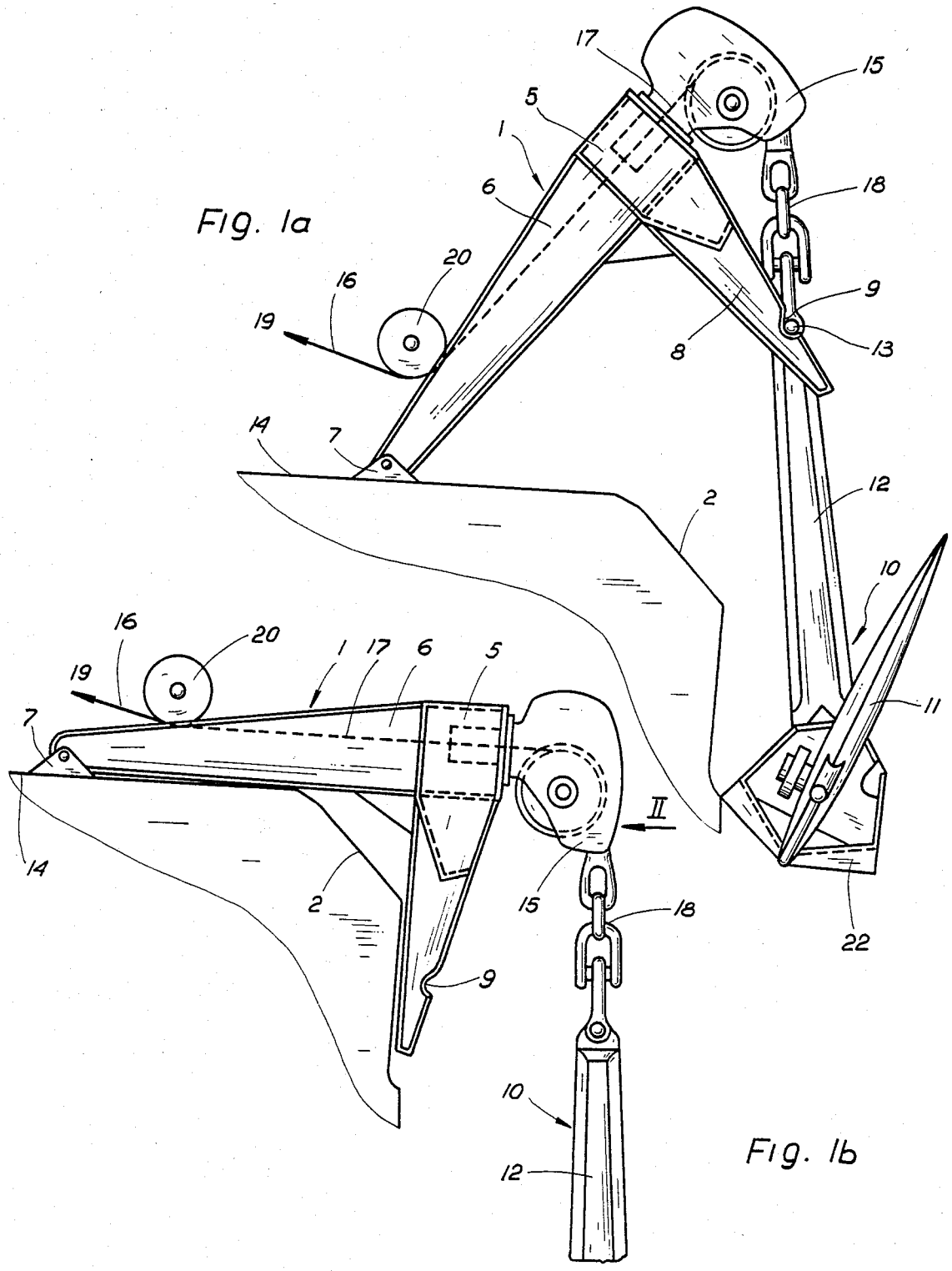
FIG. 1*a* shows the intermediate position of the anchor rack carrying the anchor.
FIG. 1*b* shows the anchor rack in its rest position.

FIG. 3 shows the anchor rack 1 cooperating with a board hawse 21 in which the anchor crown 22 and flukes 11 in the stowage position c of the rack are arrested whereby a very rigid stowage of the anchor 10 is obtained. The shank 12 is each time to be hauled through a central laterally open passage 23 in the hawse 21, in which central passage 23 the rack 1 in its anchoring position a, lying on the deck, is adapted to rest, in an also laterally well supported manner. In FIGS. 1 and 2 the anchor 10 is shown in the stowed position, lying on the deck edge 2, 14. Of course still other possibilities are present which can be effected within the scope of the invention.

The fang is of course expedient to pivot and extend the davit 6 outboard by the weight of the anchor when the line 16 is payed out by the winch, so as to always have the anchor standing by in a case of emergency.

Having thus described my invention, what I claim is:

1. An anchor davit for pivotal mounting inboard on the deck of a ship to move an anchor attached to an anchor line by a shackle and a shackle pin, said anchor line running on sheaves on the anchor davit between positions racked on board and payed out, said anchor davit having a davit post mounted on a base for pivotal movement in a vertical plane, said davit post having a jib or outrigger arm mounted on said post for supporting the anchor in its racked position, said jib having a shackle pin engaging slot in an upper side thereof for engagement with said shackle pin, said davit post having a post head adapted to accommodate a sheave for guiding the anchor line, said davit post having a further sheave spaced from said post head to guide the anchor line from the sheave in said post head centrally through the davit post to a winch during an entire operation of said davit, said jib having lateral arms arranged to rest in a recess in the deck of a ship to transmit their load thereto, said shackle pin engaging slot intercepting the shackle pin in an outboard position of said anchor between said racked and payed out positions and carrying the anchor in its rack position and to and from its payed out position, whereby when the shackle pin is caught by said shackle pin engaging slot the shackle is arrested by the sheave block on the post head whereupon hauling of the anchor line by the winch will cause the anchor davit carrying the anchor to pivot up.

2. An anchor davit according to claim 1, in which said davit is arranged to receive the anchor through a hawse located in the side of a ship.

3. An anchor davit according to claim 1, in which the sheave block positioned on the post head is adapted to pivot about an axis which is substantially parallel to the longitudinal axis of the post.

4. An anchor davit according to claim 1, in which the davit when pivoted down has a rest position right on the deck to take the anchor pull.

* * * * *